US009534409B2

(12) United States Patent
Jose

(10) Patent No.: US 9,534,409 B2
(45) Date of Patent: Jan. 3, 2017

(54) AUTOMATIC MULTIPROCESSING CAR STORING AND RETRIEVING SYSTEM FOR MULTILEVEL CAR PARK

(76) Inventor: K. T. Jose, Ankamaly (IN)

( * ) Notice: Subject to any disclaimer, the term of this patent is extended or adjusted under 35 U.S.C. 154(b) by 795 days.

(21) Appl. No.: 13/816,929

(22) PCT Filed: Jul. 28, 2011

(86) PCT No.: PCT/IN2011/000500

§ 371 (c)(1),
(2), (4) Date: Feb. 13, 2013

(87) PCT Pub. No.: WO2012/023144

PCT Pub. Date: Feb. 23, 2012

(65) Prior Publication Data

US 2013/0144688 A1 Jun. 6, 2013

(30) Foreign Application Priority Data

Aug. 19, 2010 (IN) ..... 2400/CHE/2010

(51) Int. Cl.
*E04H 6/18* (2006.01)
*E04H 6/12* (2006.01)
*E04H 6/30* (2006.01)

(52) U.S. Cl.
CPC ..... *E04H 6/12* (2013.01); *E04H 6/185* (2013.01); *E04H 6/307* (2013.01)

(58) Field of Classification Search
CPC ..... E04H 6/185; E04H 6/186; B65G 1/0435
See application file for complete search history.

(56) References Cited

U.S. PATENT DOCUMENTS 5,037,263 A * 8/1991 Yamashita ..... E04H 6/186 414/252
5,361,481 A * 11/1994 Lloyd ..... B65G 1/0407 29/407.01
5,397,211 A * 3/1995 Lloyd ..... B65G 1/0407 104/246
5,456,562 A * 10/1995 Schlecker ..... E04H 6/287 414/254
5,857,830 A * 1/1999 Harres ..... B07C 1/025 221/197
5,980,185 A * 11/1999 Vita ..... E04H 6/422 414/254
6,077,017 A * 6/2000 Durant ..... E04H 6/186 414/254
6,332,743 B1 * 12/2001 Park ..... E04H 6/186 414/234

(Continued)

*Primary Examiner* — Jonathan Snelting

(57) ABSTRACT

In view of the foregoing, an embodiment herein provides an automatic processing unit for car storing and retrieving system for the multilevel park system. Specifically, the automatic processing car storing and retrieving system includes an integrated central car handling unit and micro-controller unit, wherein said integrated central car handling unit comprises at least one collection-delivery rack to carry the car; at least one up-down platform to move the car vertically; and at least one wheeled platforms to move the car in a circular movement. Further, the collection-delivery rack of integrated central car handling unit can move simultaneously in circular and vertical direction. Further, a method for storing and retrieving the car by using the integrated central car handling unit is also provided.

13 Claims, 15 Drawing Sheets

(56) References Cited

U.S. PATENT DOCUMENTS

| | | | | |
|---|---|---|---|---|
| 6,702,541 | B1 * | 3/2004 | Lee | E04H 6/186 414/253 |
| 6,764,266 | B2 * | 7/2004 | Young | B65G 1/0435 414/276 |
| 2003/0035707 | A1 * | 2/2003 | Volpe | E04H 6/186 414/254 |
| 2007/0128009 | A1 * | 6/2007 | Lee | E04H 6/186 414/253 |

* cited by examiner

AUTOMATIC MULTIPROCESSING CAR STORING AND RETRIEVING SYSTEM FOR MULTILEVEL CAR PARK

FIELD OF INVENTION

The present invention generally relates to a multilevel car parking system, more particularly an automatic multiprocessing unit for storing and retrieving the car in the multilevel park system.

BACKGROUND OF THE INVENTION

Presently, car industry is growing rapidly at an average rate of 10 percent. In order to accommodate the large volume of vehicles, infrastructure of the cities such as road, flyovers, car parking and other facilities needs to be improved in the city. Lack of enough parking spaces near shopping centers, hospital, theater, railway station, airport etc., encourages the tendency to park car on the road side illegally which aggravate the traffic menace. Lots of money gets wasted in case of a theft or damage of vehicle when it parked unattended on the road side. Parking a car in busy parking lot in cities is a nightmare for senior citizens.

Conventionally, a multilevel car parking system is one of the options to decongest roads and solve parking problems associated with the above and to maximize the car parking capacity by utilizing vertical space, rather than expand horizontally. According to this method, driving ramps are provided to drive the vehicle to each level of parking. It is found that the ramp eat up much parking area that no increase in parking capacity is possible. Further, this system requires lot of space for maneuvering of cars while parking and retrieving. Moreover, the car has to move slowly due to sloppy ramps and to search for vacant parking bay, thereby resulting in burning lots of fuel and polluting the air. In addition, lots of time to be spend to find a vacant space and to park the car in available space. The car in the driving path should stop when somebody wants to take a car out from parked slot. In this scenario, height of each level should be much higher than the car height to accommodate the movement of passenger and driver. This system has an associated amount of overhead that must be accommodated such as pathways, lighting and air ventilation system for passengers and drivers, and security personnel to avoid theft.

Recently, automatic multilevel parking systems are developed and adopted to overcome the problem associated with conventional multilevel parking systems. In general, this system consists of pallets in which the cars are parked at entry point. The pallet along with car is then placed on a slider powered by electrical motor and moves horizontally to nearest lift mechanism. Then the slider transfers the pallet with car to the lift and the lift moves vertically to take the pallet to the desired level. Further the pallet is again transferred to another slider which takes the pallet to a designated spot and transfers the car to a desired slot. It has been observed that the process consumes a lot of time to transfer the cars between slider to lift, lift to slider and finally to slot. This leads to longer waiting time for a driver to store/retrieve a vehicle to/from the parking bay. And also in each level, this system requires motor powered sliders and guiding rails for sliders moving horizontally. This complicated system needs much man power for maintenance and initial cost will be high.

There therefore exists a need in the art to provide for an automatic multilevel parking system that not only reduces the time to park a vehicle but also to have low maintenance and cost effective system.

OBJECTS OF THE INVENTION

A main object of the present invention is to provide an automatic multiprocessing car storing and retrieving system for multilevel car park.

Another object of the present invention is to provide an automatic multiprocessing car storing and retrieving system which is faster and consumes less energy.

Yet another object of the present invention is to provide an automatic multiprocessing car storing and retrieving system which can move simultaneously in vertical and horizontal.

Still another object of the present invention is to provide an automatic multiprocessing car storing and retrieving system which can move simultaneously in vertical and horizontal direction so that the car can be carried in a straight line from reception point to storing point at a shorter distance and at a shorter time.

Another object of the present invention is to provide an automatic multiprocessing car storing and retrieving system which can maximize the space utilization of floor area and height.

Yet another object of the present invention is to provide an automatic multiprocessing car storing and retrieving system which can process multiple cars at same time to manage peak time rush.

Still another object of the present invention is to provide an automatic multiprocessing car storing and retrieving system which needs no man power for working the system.

Still another object of the present invention is to provide an automatic multiprocessing car storing and retrieving system in which only maintenance/technical person have access to the parking structure so that the chance for theft and damage can be eliminated.

Still another object of the present invention is to provide an automatic multiprocessing car storing and retrieving system in which to have an integrated central car handling unit which comprises all the moving parts of system.

Still another object of the present invention is to provide an automatic multiprocessing car storing and retrieving system to devise a gliding platform which slides with pulleys on parallel rails and act as base for integrated central car handling unit.

Still another object of the present invention is to provide an automatic multiprocessing car storing and retrieving system is to devise a micro controller unit which takes inputs from plurality of optical/laser sensors about the position of the cars and use this inputs to plan and command all the movements using reversible electrical motors with fitted brakes.

The other objects and advantages of the present invention will be apparent from the following description when read in conjunction with the accompanying drawings which are incorporated for illustration of preferred embodiments of the present invention and are not intended to limit the scope thereof.

SUMMARY OF THE INVENTION

In view of the foregoing, an embodiment herein provides an automated multiprocessing car storing and retrieving system comprises an integrated central car handling unit and a microcontroller unit, wherein said integrated central car handling unit comprises at least one collection-delivery rack to carry the car; at least one up-down platform to move the car vertically; and at least two gliding platforms to move the car horizontally. Further, collection-delivery rack of the integrated central car handling unit can move simultaneously in horizontal and vertical direction. The collection-delivery rack can independently move laterally on sliding slot with help of rope & pulley mechanism, and said collection-delivery rack is attached to the up-down platform, wherein said up-down platform is guided on four pillars and moves up and down vertically with the help of rack & pinion mechanism. The top and bottom side of four guiding pillars of up-down platform fixed to the gliding platforms which moves horizontally on four guiding rails with the help of pulley & rail mechanism.

In an embodiment, a method for storing and retrieving a car using an integrated central car handling unit at multilevel car park structure, wherein said method comprising the step of parking a car with brake engaged at wheel holding mechanism provided at parking bay of entry point, inserting a collection-delivery rack of said central car handling unit in the parking pay to lift the car from said parking bay, collecting said car with said collection-delivery rack at a vertical frame of an up-down platform of said central car handling unit, moving said car to a vacant slot at multilevel car park structure, wherein said movement of car is achieved by simultaneous horizontal and vertical movement of said collection-delivery rack, delivering said car to a parking bay of said vacant slot with the lateral movement of said collection-delivery rack; and parking said car at said parking bay of vacant slot. In an embodiment, a method to retrieve a car from the parking bay of parking slot, all the above steps is performed in reverse order.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION OF THE PREFERRED EMBODIMENTS

Figure 1:
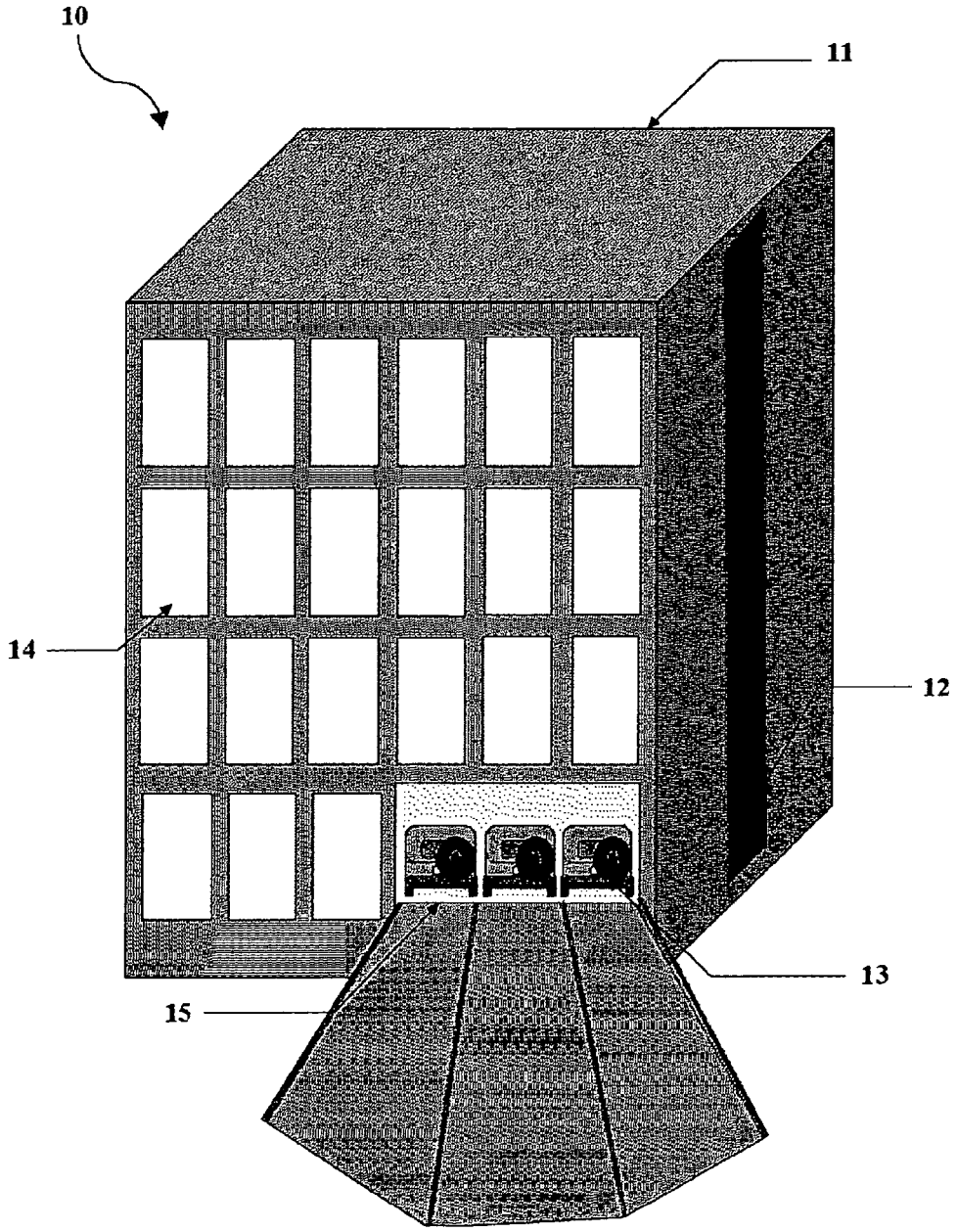
FIG. 1 illustrates a general view of multilevel parking system with three cars at entry/exit point, according to an embodiment herein.

The embodiments herein and the various features and advantageous details thereof are explained more fully with reference to the non-limiting embodiments and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein As mentioned, there remains a need for an automated multiprocessing car storing and retrieving system for multilevel car park. The embodiments herein achieve this by providing an integrated central car unit and a microcontroller unit. Referring now to the drawings, and more particularly to FIGS. 1 through 20, where similar reference characters denote corresponding features consistently throughout the figures, there are shown preferred embodiments.

It is to be noted that even though the description of the invention has been explained using multilevel car parking system, it should, in no manner, be construed to limit the scope of the invention. The systems and methods of the invention can apply to any types of storage and retrieval system.

FIG. 1 illustrates a general view 10 of multilevel parking system with three cars 13 at entry/exit point 15 of car parking building 11, according to an embodiment. The car parking facilities in the parking system can be either above or below the ground level. In an embodiment, the car entry and exit point can be at same place. In another embodiment, the car entry and exit point can be at different place. The car entry/exit point 15 has sufficient height to allow the people to access, whereas the entire car parking slot 14 has just sufficient height to accommodate the vehicle. The car 13 is placed at the entry/exit point 15 to park the car at the desired parking slot 14. At the entry/exit point 15, a parking token wending machine [not shown] is provided to collect parking token, and a PIR sensor [not shown] is provided to identify the presence of a person inside the parking pay.

Figure 2:
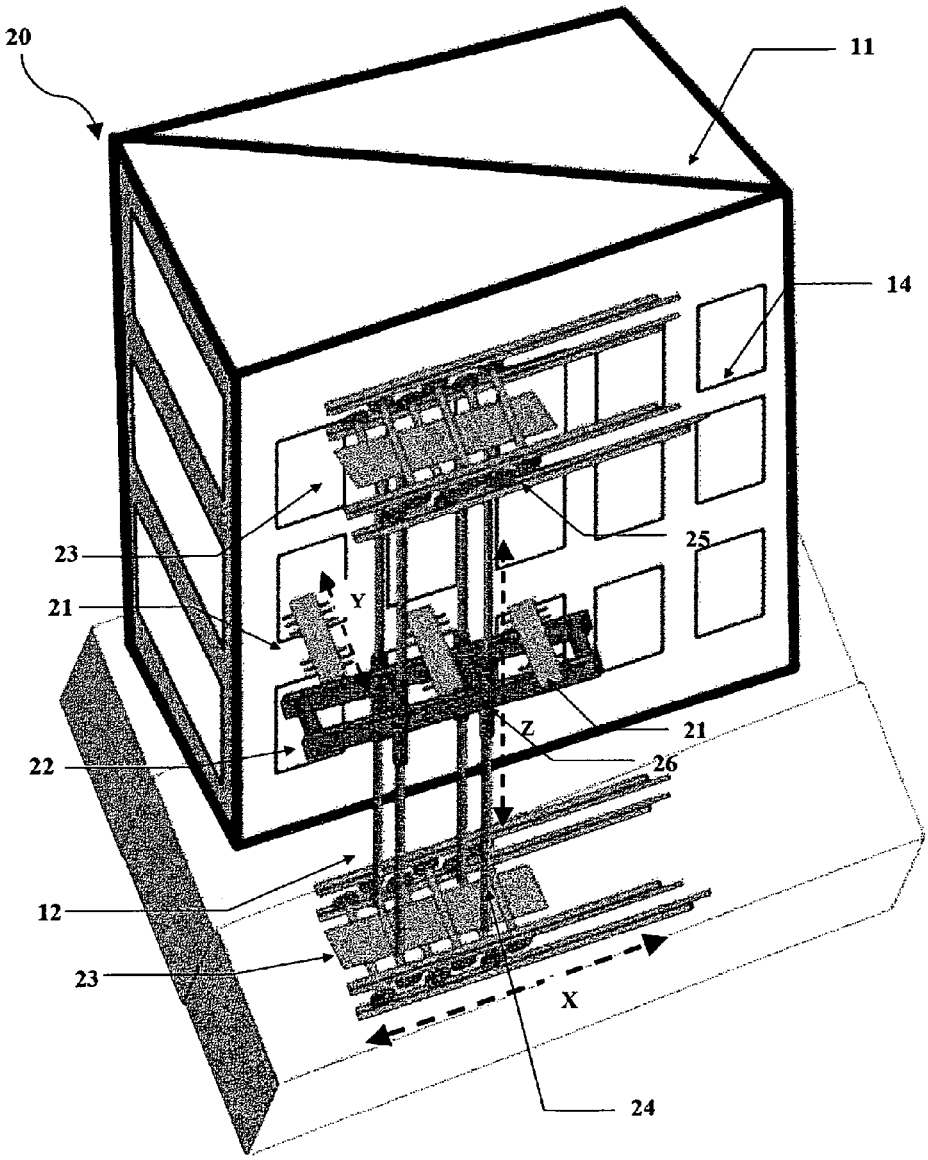
FIG. 2 illustrates a general view of integrated central car handling unit provided with three collection-delivery racks, according to an embodiment herein.

FIG. 2 illustrates a general view 20 of an integrated central car handling unit 12, according to an embodiment. In accordance with one embodiment, the central car handling unit 12 comprises at least one collection-delivery rack 21, an up-down platform 22, and two gliding platforms 23. The collection-delivery rack 21 slides laterally in the direction Y with the help of rope & pulley mechanism [not shown] to deliver/collect the car 13, the up-down platform 22 moves up and down vertically in the direction Z with the help of four guiding pillars 24 and rack & pinion mechanism [not shown] to carry the collection-delivery rack 13 along with the car 11, and the gliding platforms 14 moves horizontally in the direction X on guiding rails 25 with the help of pulley and rail mechanism [not shown] to carry guiding pillars 24 of up-down platform 22. Accordingly, the collection-delivery rack 21 moves in all three dimensions to deliver/collect the car 13 at appropriate positions.

Figure 3:
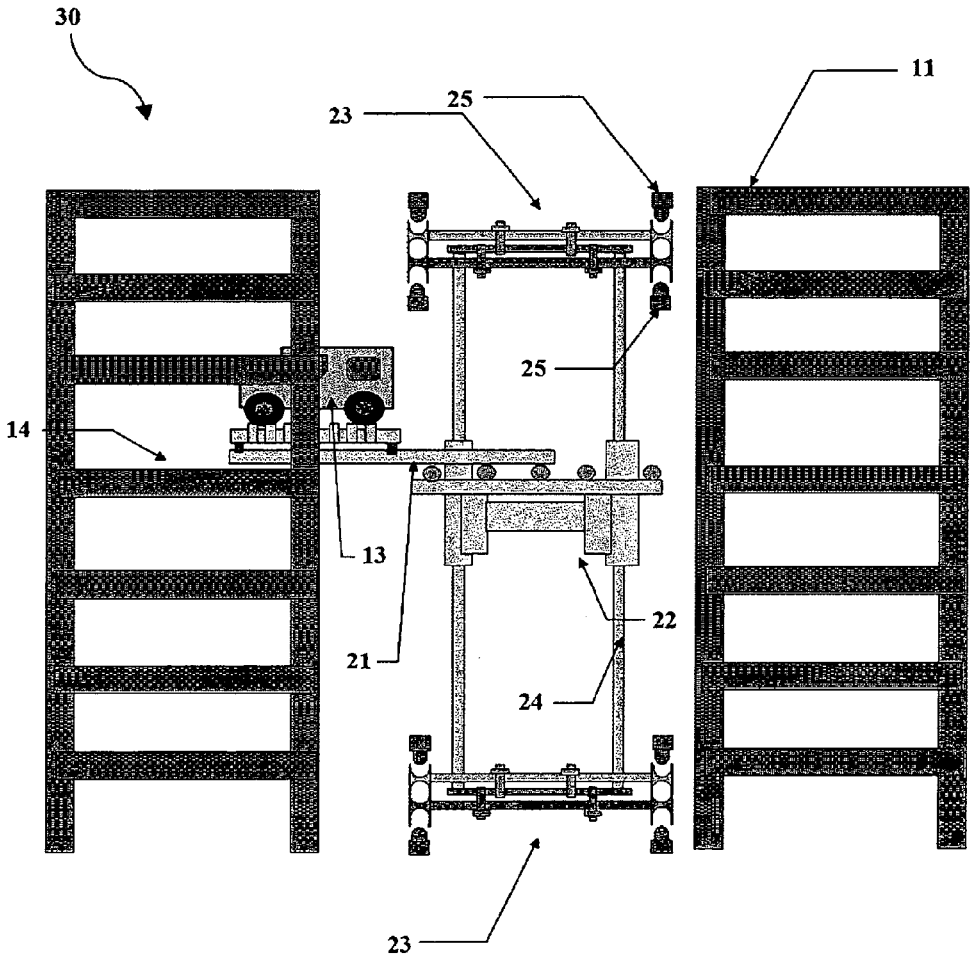
FIG. 3 illustrates side view of integrated central car handling unit, according to an embodiment herein.

Now referring to FIG. 3, the side view 30 of the integrated central car handling unit 12 is illustrated, according to an embodiment. The collection-delivery rack 21 can move simultaneously in horizontal and vertical direction, with the help of vertical movement of up-down platform 22 and horizontal movement of gliding platforms 23. The car 13 placed on the collection-delivery rack 21 can move simultaneously in horizontal [X direction] and vertical [Z direction] from the entry point to reach to desired parking position 14 and vice versa, according to an embodiment. After reaching to desired position, the collection-delivery rack 21 is configured to move laterally [Y direction] in order to move the car 13 from the central car handling unit 12 to the parking slot 14 and vice versa, as shown in FIG. 3.

Figure 4:
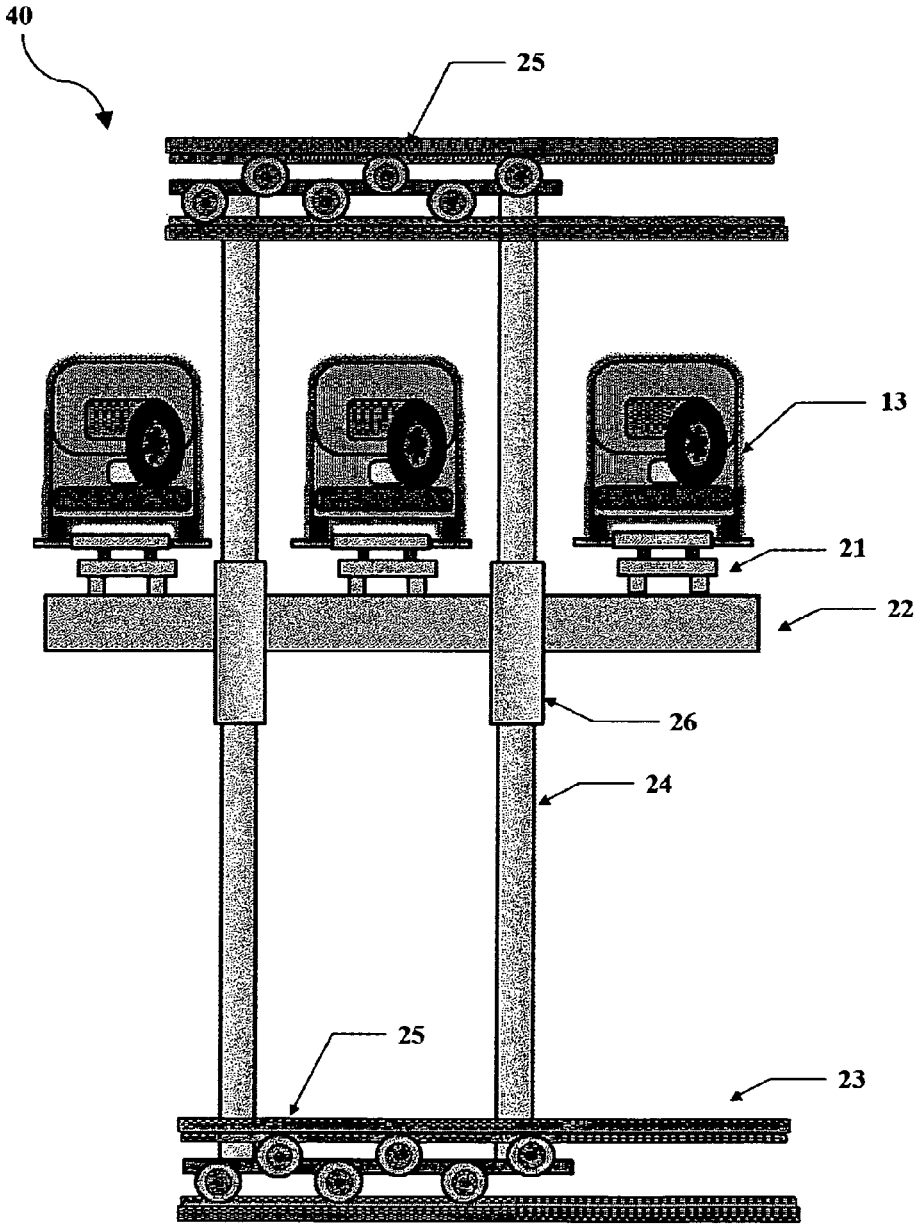
FIG. 4 illustrates front view of integrated central car handling unit, according to an embodiment herein.

FIG. 4 illustrates the front view 40 of the integrated central car handling unit 12, according to an embodiment. In a preferred embodiment, the car 13 placed on the collection-delivery rack 21 moves simultaneously in horizontal and vertical direction to reach to the desired/available parking position according to instruction provided from the micro-controller unit. In another embodiment, the car 13 placed on the collection-delivery rack 21 moves in horizontal and vertical direction independently, thereby enabling the car 13 to move from the entry point to parking slot 14 position and vice versa without removing the car 13 from the collection-delivery rack 21. In yet another embodiment, the car 13 placed on the collection-delivery rack 21 moves in horizontal direction first to the position parallel to the parking slot 14 and further moves in vertical direction to the parking slot 14 position and vice versa without removing the car 13 from the collection-delivery rack 21. In yet another embodiment, the car 13 placed on the collection-delivery rack 21 moves in vertical direction first to the position parallel to the parking slot 14 position and further moves in horizontal direction to the parking slot 14 position and vice versa without removing the car 13 from the collection-delivery rack 21.

In accordance with one embodiment, the collection-delivery rack 21 is attached the up-down platform 22, and the up-down platform 22 is connected to the gliding platforms 23 through the top and bottom end of guiding pillars 24 of the up-down platform 22, wherein the up-down platform 22 is attached to four sleeves 26 which slides on the four guiding pillars 24.

Figure 5:
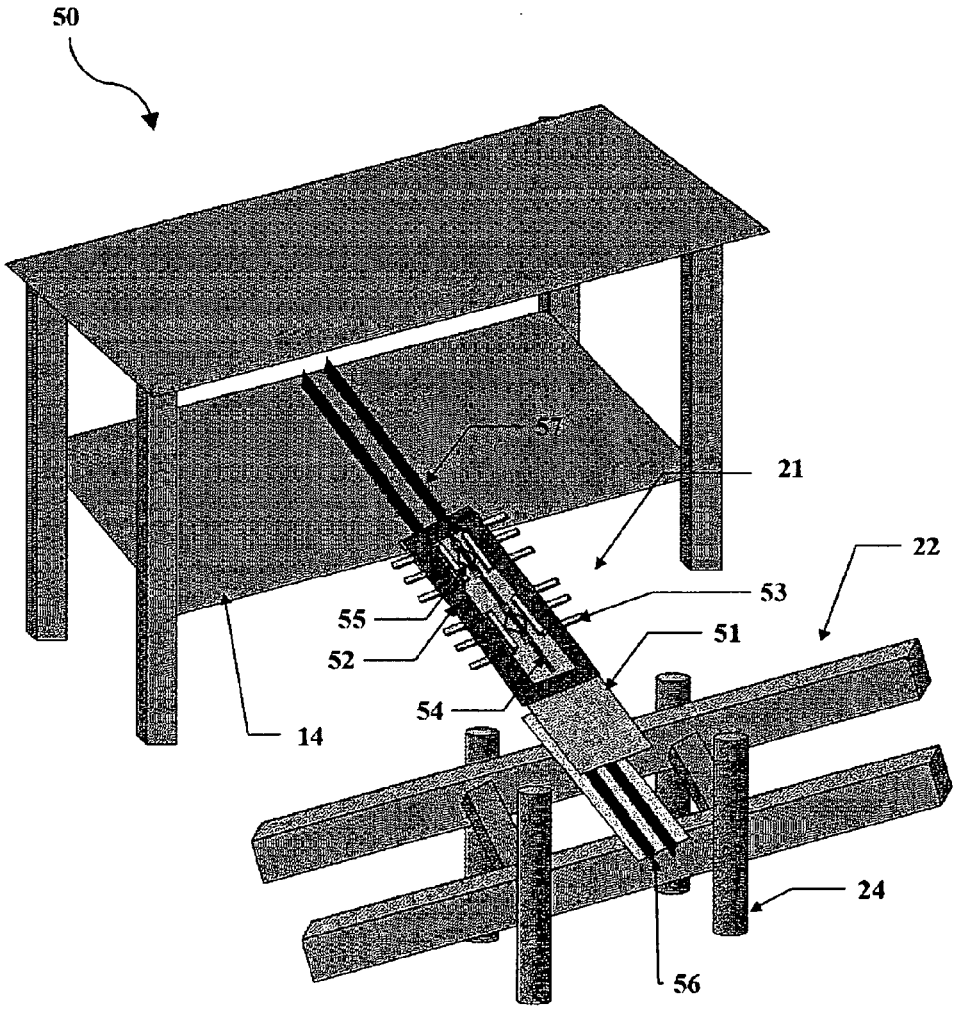
FIG. 5 illustrates a general view of collection-delivery rack engaging with a vacant slot, according to an embodiment herein.

FIG. 5 illustrates a general view of collection-delivery rack 21 engaging with a vacant slot 14, according to an embodiment. According to an embodiment, the collection-delivery rack 21 comprises a moving frame 51, a holding frame 52, plurality of wheel arresting mechanism 53, a threaded rod 54, and at least two jackey means 55, wherein said moving frame 51 slides on sliding slot 56 provided in the up-down platform 22 and to engage with sliding slot 57 provided in the parking bay 71. Accordingly, the car 13 placed over the collection-delivery rack 21 can move laterally [Y direction] from the up-down platform 22 to the parking slot 14 and vice versa. All the mechanism provided at the parking slot 14 are same as that of provided at the parking bay of entry/exit point 15.

Figure 6:
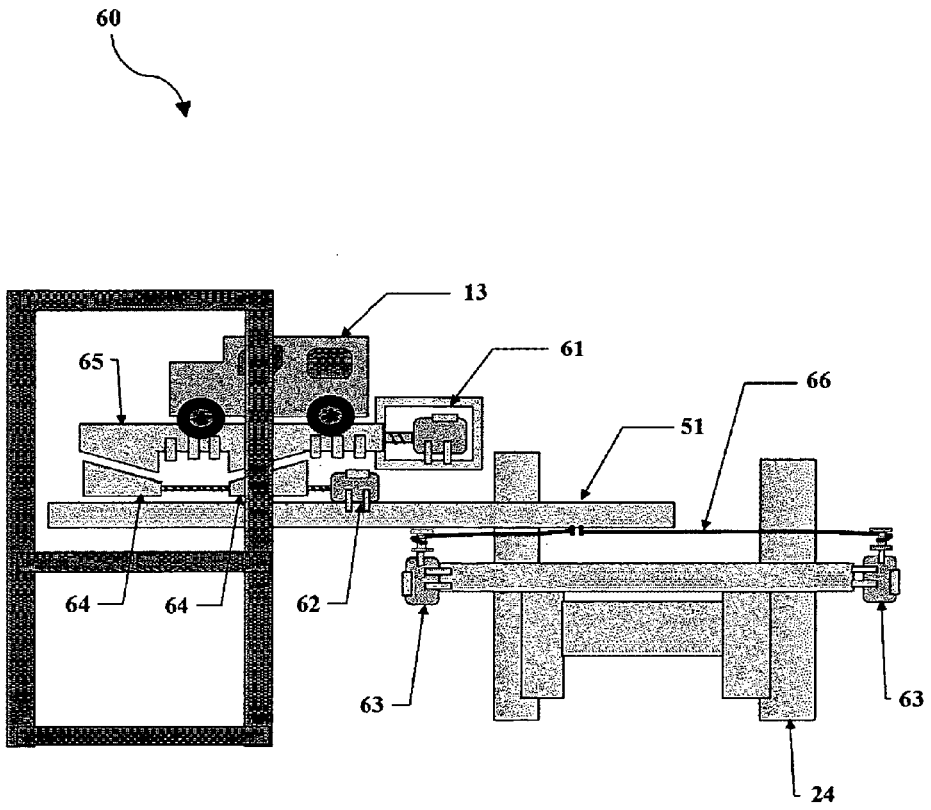
FIG. 6 illustrates side view of collection-delivery rack carrying a car to vacant slot, according to an embodiment herein.

FIG. 6 illustrates side view of collection-delivery rack 21 carrying a car 13 to vacant slot 14, according to an embodiment. In the up-down platform 22, two reversible electric motors 63 are provided and attached with rope & pulley mechanism 66, wherein the rope & pulley mechanism 63 is connected with the moving frame 51 of the collection-delivery rack 21. Accordingly the collection-delivery rack 21 can move laterally when the electric motors 63 are operated to move the moving frame 51 from the up-down platform 22 to the parking slot 14. A set of movable triangular block 64 provided on the moving frame 51 slides on moving frame 51 against fixed block 65 of the holding frame 52 such a way that to lift the holding frame 52 along with the wheel arresting mechanism 53. A reversible electric motor 62 with fitted brake is provided at the moving frame 51 to slide the movable triangular block 64 in both direction depending upon the requirement of lifting or parking the car at parking slot 14.

Figure 7:
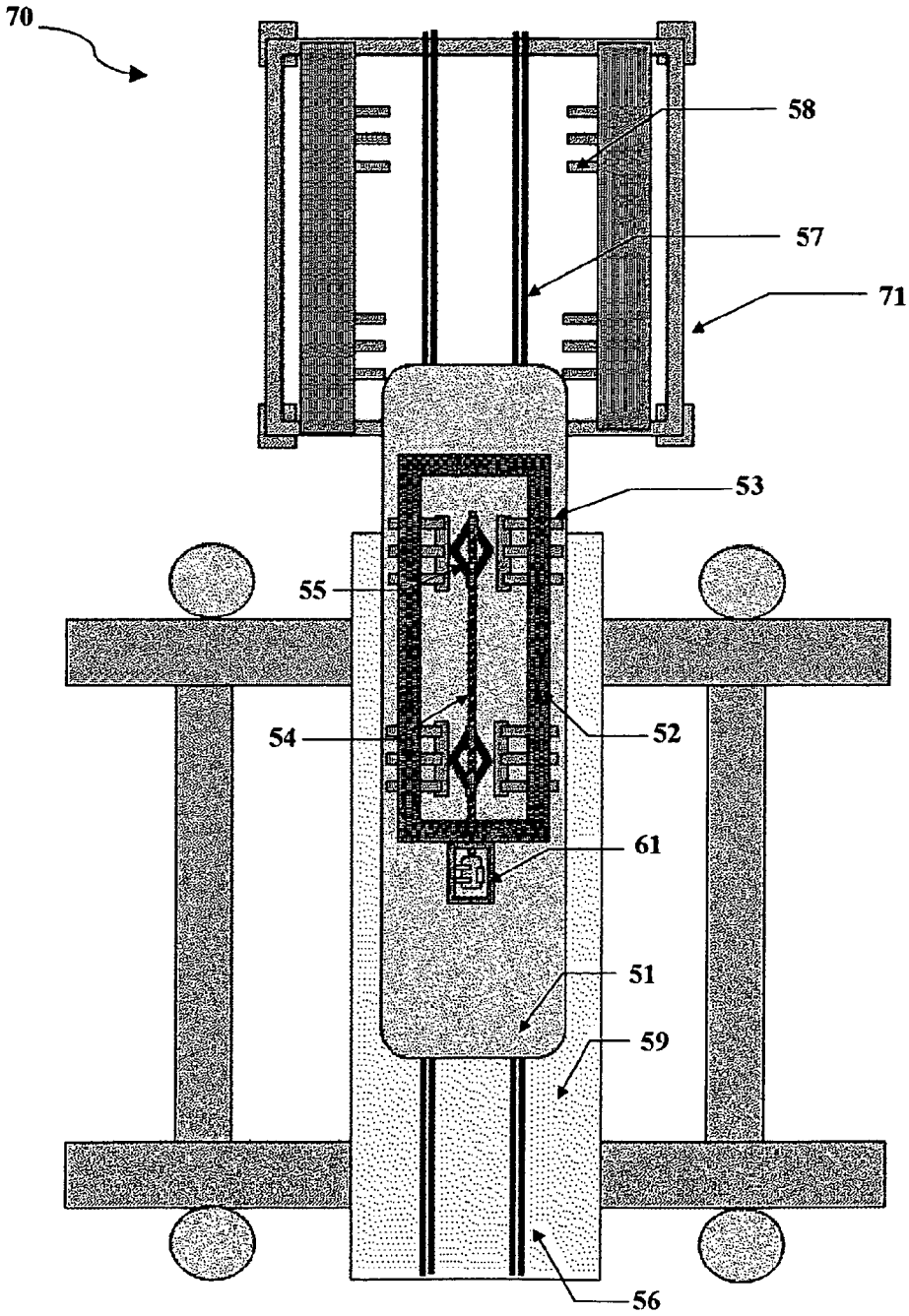
FIG. 7 illustrates top view of collection-delivery rack with wheel arresting mechanism contracted, according to an embodiment herein.
Figure 8:
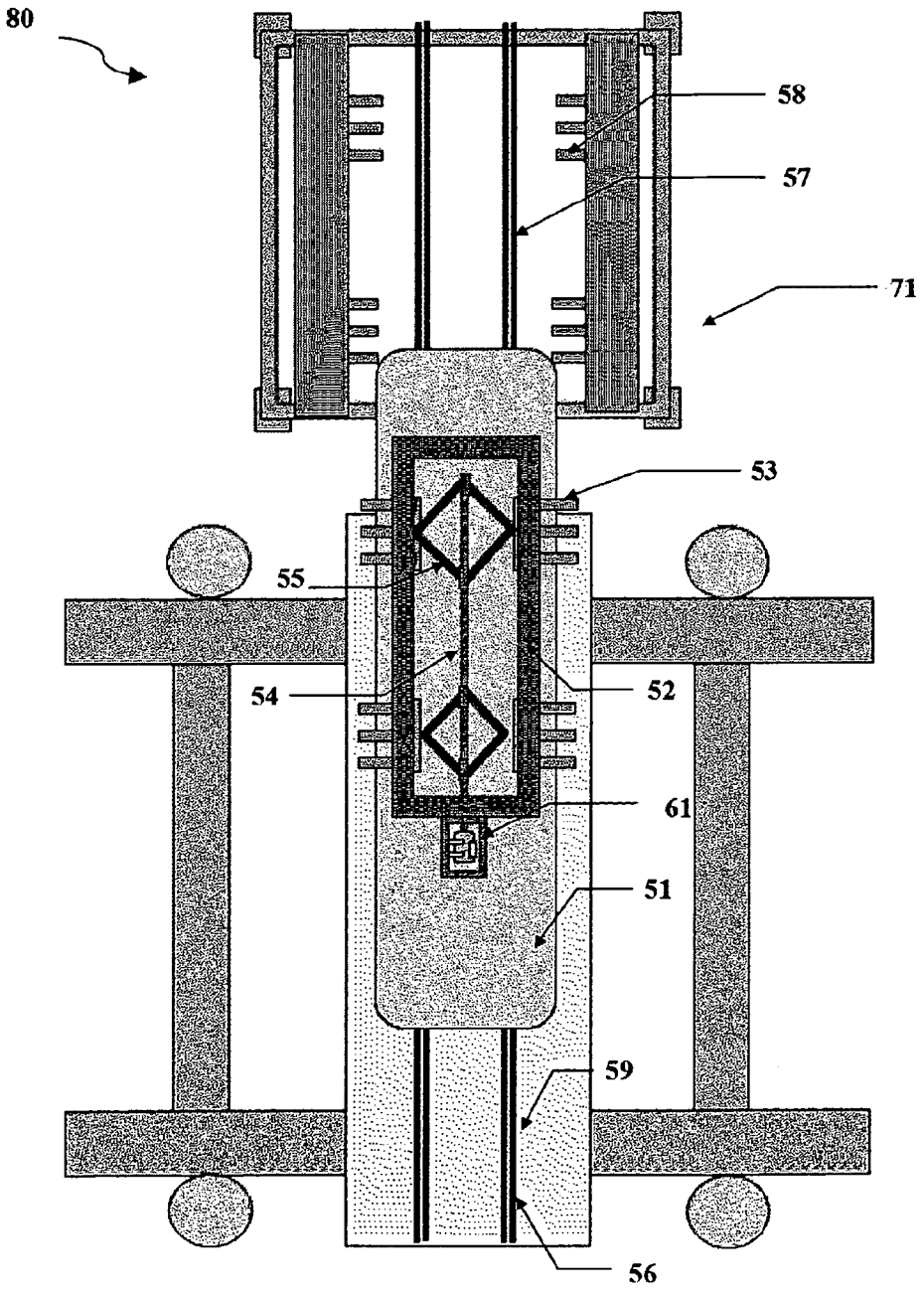
FIG. 8 illustrates top view of collection-delivery rack with wheel arresting mechanism expanded, according to an embodiment herein.
Figure 9:
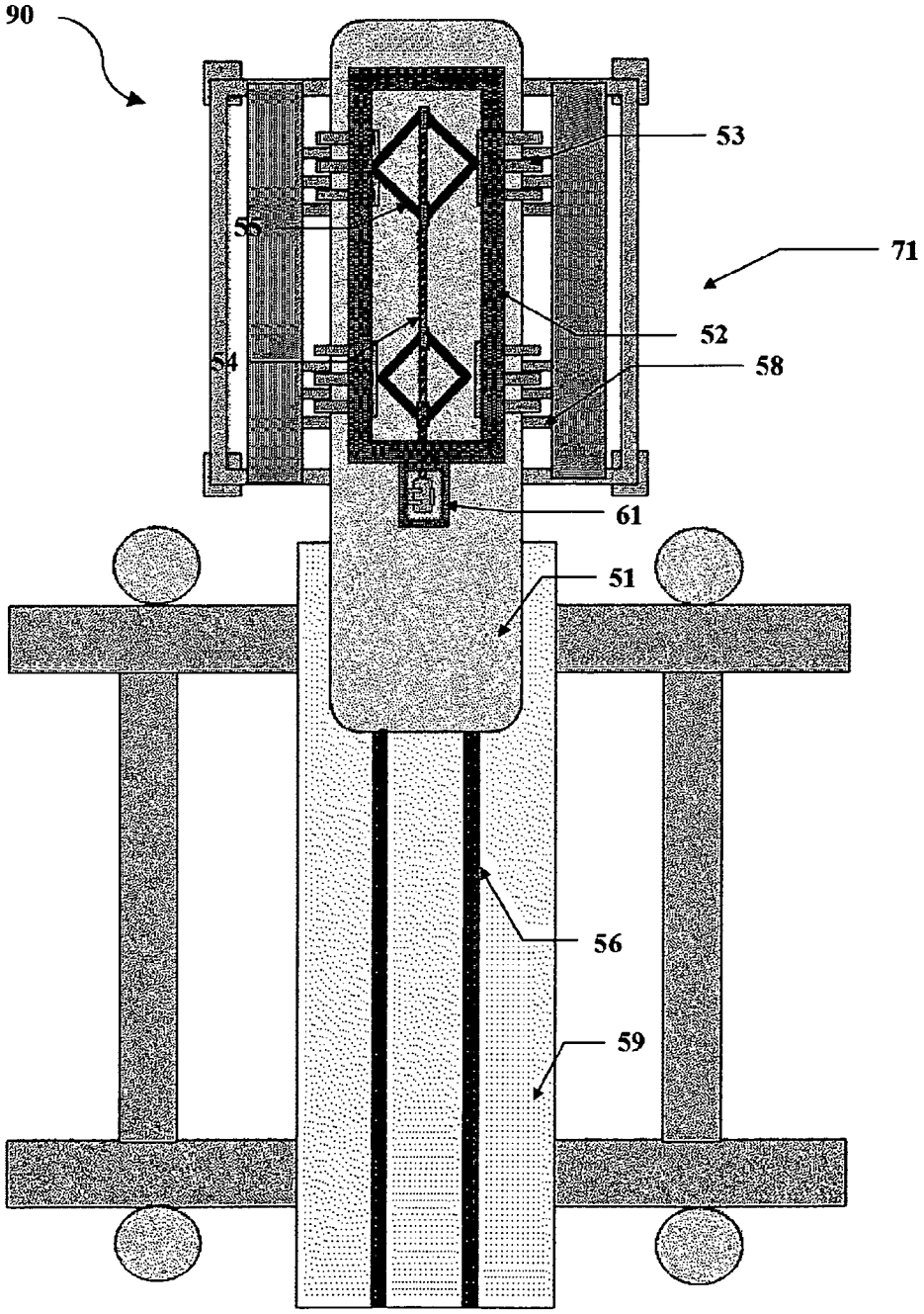
FIG. 9 illustrates top view of collection-delivery rack with wheel arresting mechanism engaged to the wheel arresting mechanism of a vacant slot, according to an embodiment herein.

Now referring to FIG. 7, FIG. 8, FIG. 9, it illustrates top view of collection-delivery rack 21 and various position of moving frame 51, according to an embodiment. For ease of understanding, the parking bay 71 shown in FIG. 7, FIG. 8, FIG. 9 is same at the parking slot 14 and at the entry/exit point 15, The moving frame 51 slides on the sliding slots 56, 57 provided on the up-down platform 22 and parking bay 71. Accordingly the moving frame 51 moves from the up-down platform 22 to the parking bay 71 and vice versa based on the need of parking or lifting the car at parking bay 71. The jackey means 55 attached with the threaded rod 54 is connected to the wheel arresting mechanism 53 provided in the holding frame 52, wherein the jackey means 55 expands or contracts to push or pull the wheel arresting mechanism 53 when the threaded rod 54 rotates in clockwise or anti-clockwise respectively. The rotation of the threaded rod 54 is achieved with the help of a reversible electrical motor [with fitted brake] 61 provided in the holding frame 52. FIG. 7 illustrates position of the moving frame 51 over the vertical frame 59, jackey means in contracted position and the wheel arresting mechanism 53 in inward position. FIG. 8 illustrates position of the moving frame 51 over the vertical frame 59, jackey means in expanded position and the wheel arresting mechanism 53 in outward position. FIG. 9 illustrates top view of collection-delivery rack with wheel arresting mechanism 53 engaged to the wheel arresting mechanism 58 of a vacant slot 14.

Figure 10:
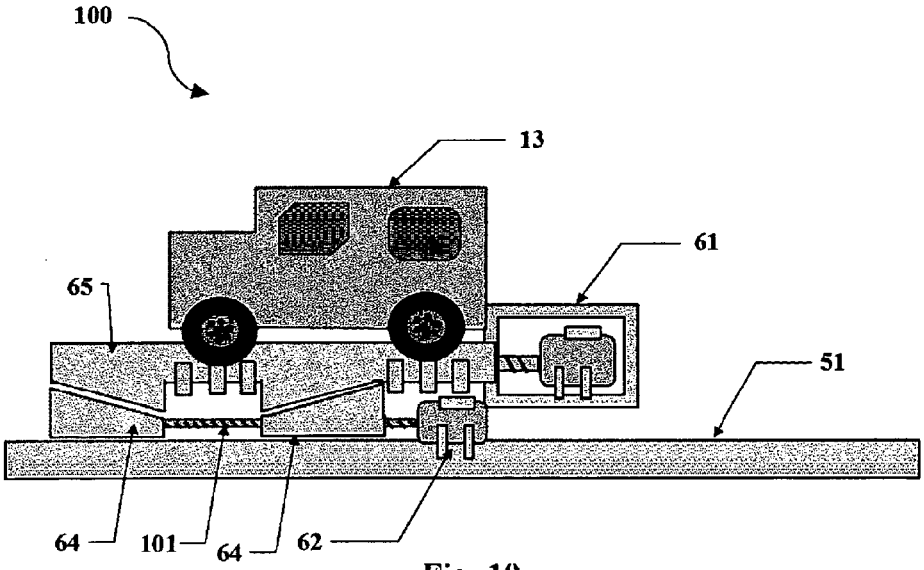
FIG. 10 illustrates side view of collection-delivery rack with triangular blocks are at released position, according to an embodiment herein.
Figure 11:
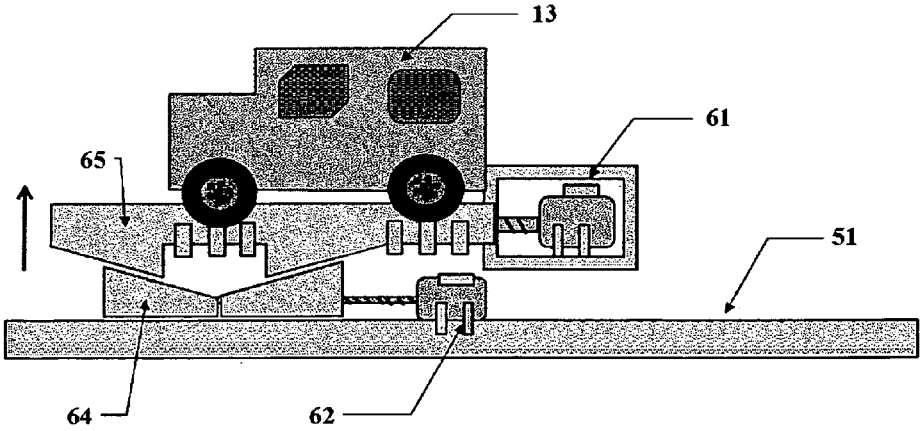
FIG. 11 illustrates side view of collection-delivery rack with triangular blocks are moved closer so that the holding frame gains height, according to an embodiment herein.

FIG. 10 illustrates side view of collection-delivery rack 21 with triangular blocks 64 are at released position, according to an embodiment. A set of movable triangular block 64 provided on the moving frame 51 slides on moving frame 53 against fixed block 65 of the holding frame 52 such a way that to lift the moving frame 53 along with the wheel arresting mechanism 53. A reversible electric motor 62 with fitted brake is provided at the moving frame 51 to slide the movable triangular block 64 in both direction depending upon the requirement of lifting or parking the car at parking bay 71. Accordingly, the moving frame 53 along with the wheel arresting mechanism 53 is lifted upward direction, as shown in FIG. 11, when both the triangular blocks 64 are moved closer.

Figure 12:
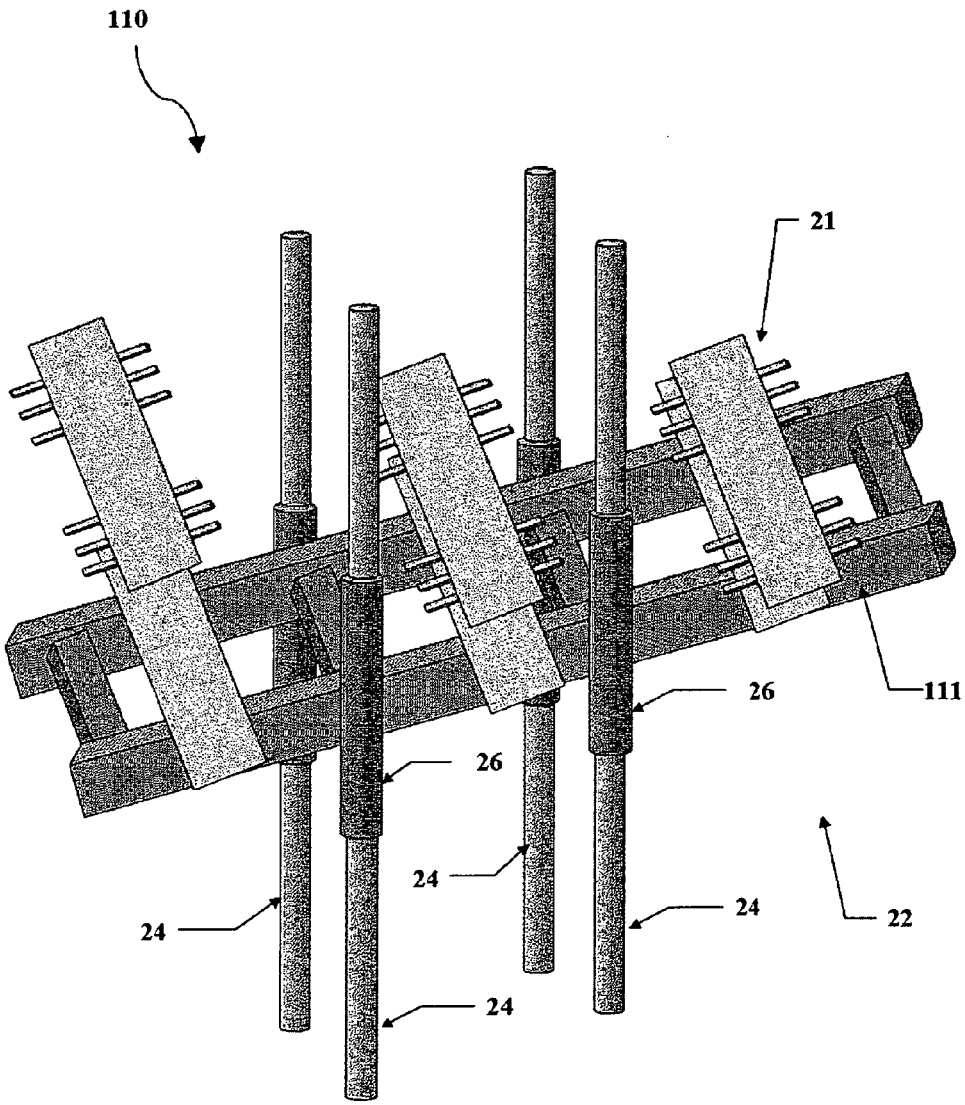
FIG. 12 illustrates a general view of up-down platform provided with three collection-delivery rack, according to an embodiment herein.

FIG. 12 illustrates a general view of up-down platform 22 provided with three collection-delivery rack 21, according to an embodiment. The up-down platform 22 includes a holding platform 111, a set of four sleeves 26, and four guiding pillars 24, wherein the holding platform 111 is fitted with the four sleeves 26 which slides on the guiding pillars 24.

Figure 13:
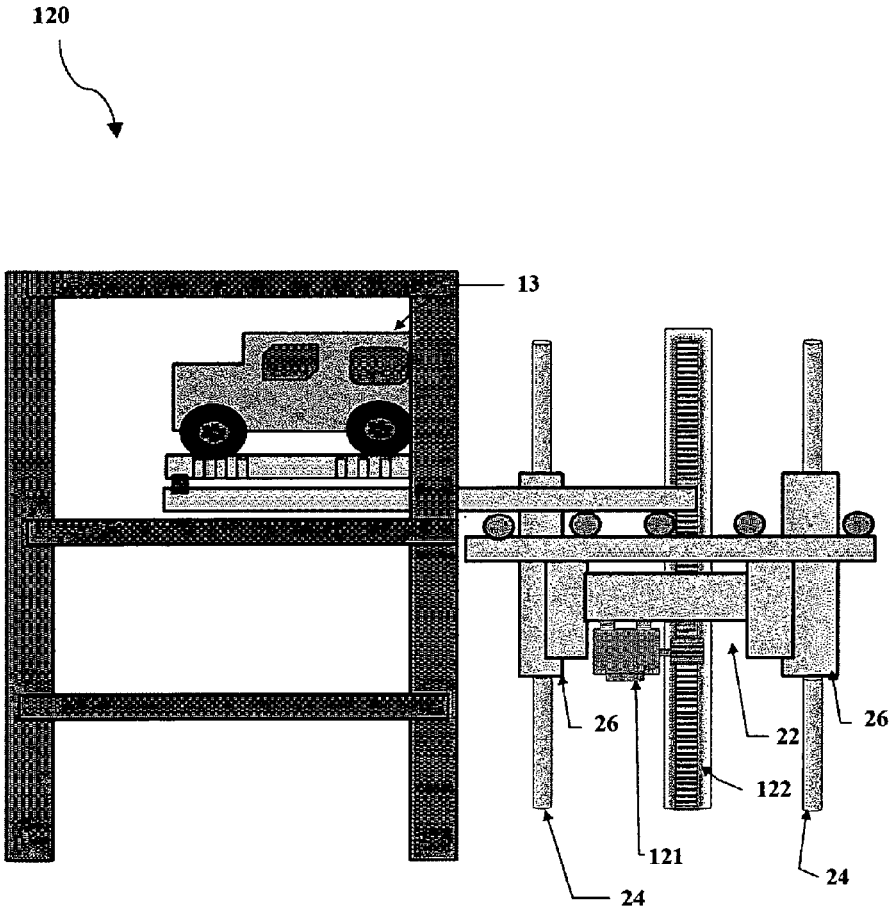
FIG. 13 illustrates side view of up-down platform with collection-delivery rack attached, according to an embodiment herein.
Figure 14:
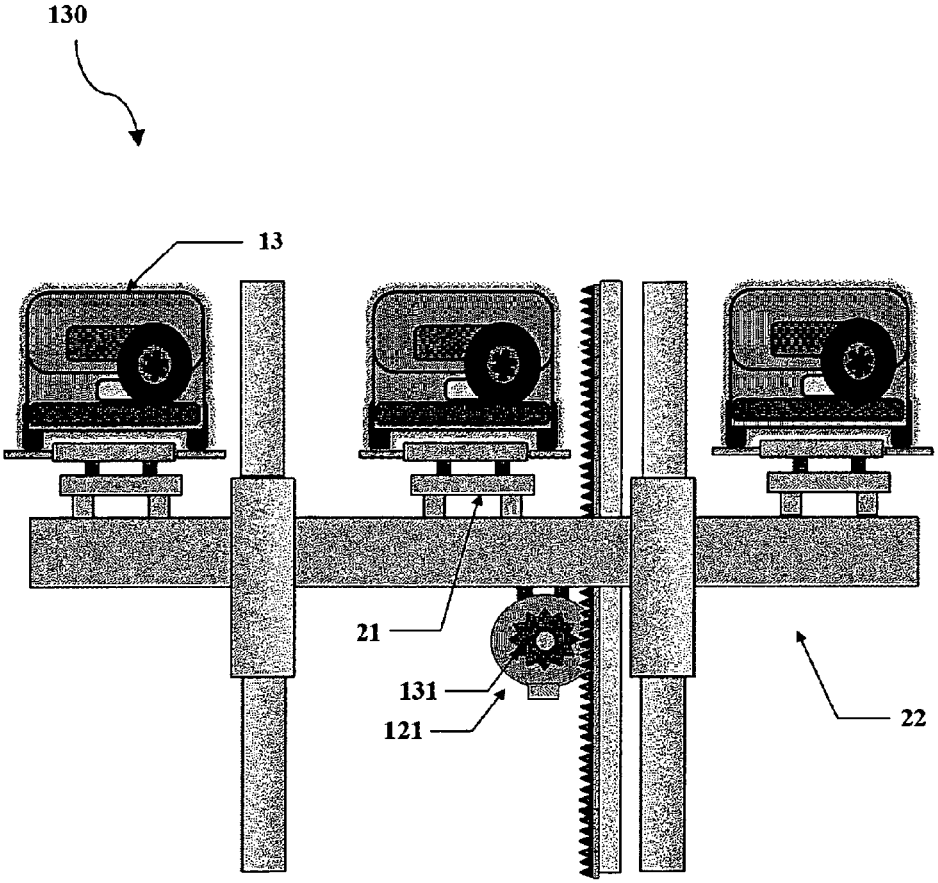
FIG. 14 illustrates front view of up-down platform with collection-delivery racks carrying cars with them, according to an embodiment herein.

FIG. 13 illustrates side view of up-down platform 22 with collection-delivery rack 21, according to an embodiment. FIG. 14 illustrates front view of up-down platform 22 with collection-delivery racks 21 carrying cars 13 with them, according to an embodiment. The up-down platform 22 further includes a rack 122 & pinion 131 mechanism and a reversible electrical motor [with fitted brakes] 121, wherein said rack 122 & pinion 131 mechanism enables the up-down platform 22 to move up and down, with the help of reversible electrical motor 121.

Figure 15:
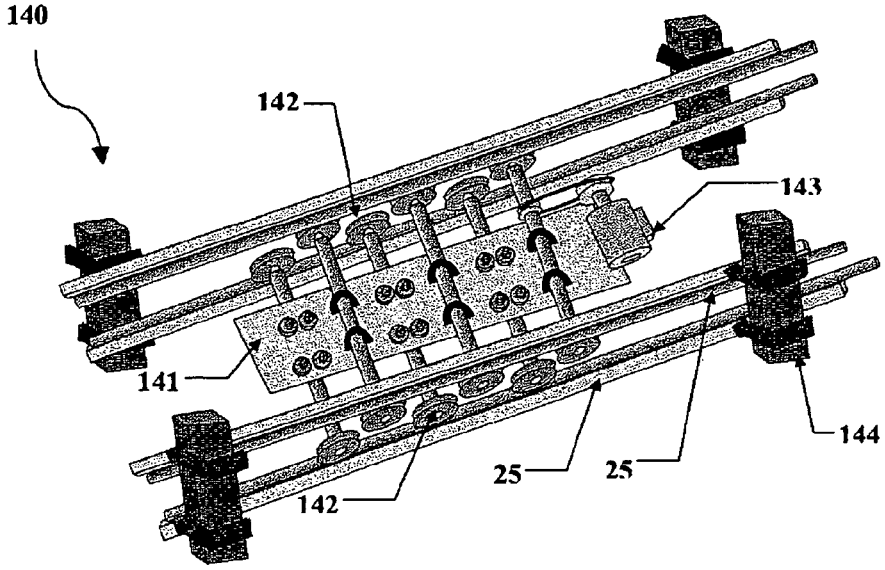
FIG. 15 illustrates a general view of gliding platform and guiding rail, according to an embodiment herein.
Figure 16:
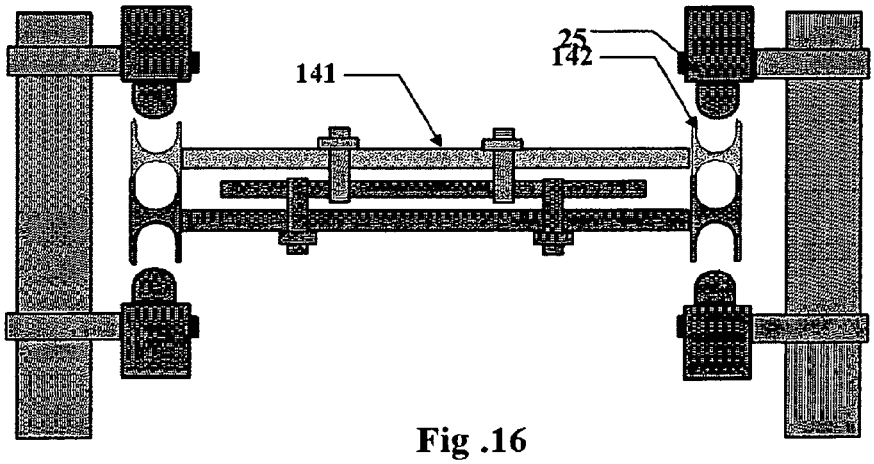
FIG. 16 illustrates side view of gliding platform with guiding rail, according to an embodiment herein.
Figure 17:
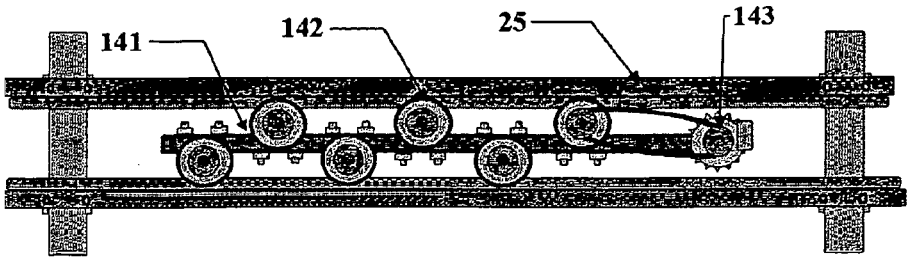
FIG. 17 illustrates front view of gliding platform with guiding rail, according to an embodiment herein.

FIG. 15, FIG. 16, FIG. 17 illustrates a general view, side view, front view of gliding platform 23 and guiding rail 25 respectively, according to an embodiment. The gliding platform 23 includes a metal block 141, plurality of pulley 142, a set of four guiding rail 25, and a reversible electrical motor [with fitted brakes] 143, wherein the pulley 142 are connected with both the end of metal block 141 and slides on the guiding rail 25, thereby enables the gliding platform 23 to move horizontally.

Figure 18:
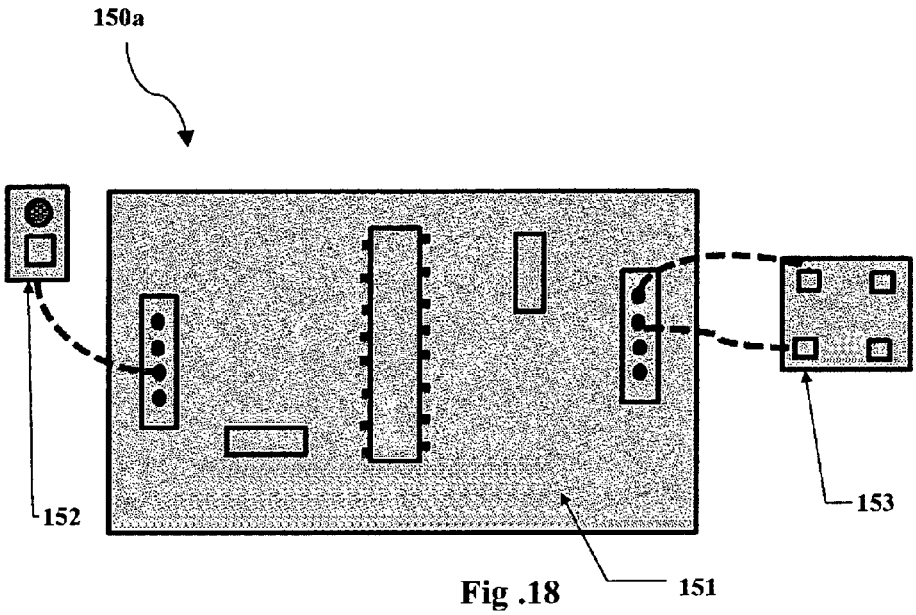
FIG. 18 illustrates a general view of a micro controller unit which plans and command all the movements, according to an embodiment herein.

FIG. 18 illustrates shows a general view of a micro controller unit 150*a* which plans and commands all the movements of various parts included in the central car handling unit 12, according to an embodiment. The micro controller unit 150*a* includes a micro controller 151, supporting circuits, plurality of relay 153 circuits to control electrical motors provided in the central car handling unit 12 and provision to take input from optical/laser sensors 152 and pay booth, wherein the optical/laser sensor 152 are placed at various position in the multilevel car parking area.

Figure 19:
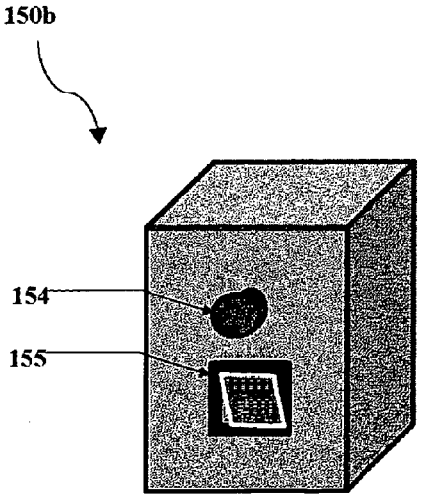
FIG. 19 illustrates a token wending machine, according to an embodiment herein.

FIG. 19 illustrates a token wending machine, according to an embodiment. The token wending machine comprises of a press button 154 and token delivery facility 155, wherein the token delivery facility 155 delivers a token when a car driver presses the press button 154 at the time parking his car at entry point 15.

Figure 20:
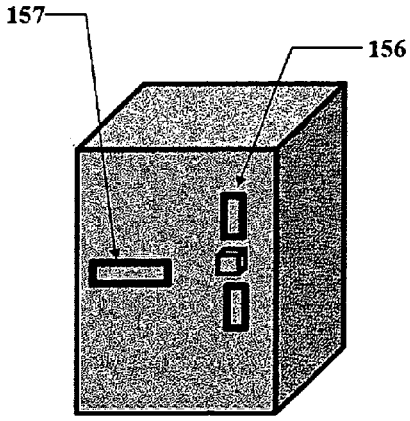
FIG. 20 illustrates a pay booth and a token return facility, according to an embodiment herein.

FIG. 20 illustrates a pay booth, according to an embodiment. The pay both includes a token return facility 157 and a coin deposit slot 156, wherein the token return facility 157 is provided to deposit the token and the coin deposit slot 156 is to provided to deposit the money by the car driver at the time of collecting his car at exit point 15.

Operations of the System

In an embodiment, a car driver parks his car and the parking brakes are engaged at the parking bay provided at the entry point 15. The wheel of car is positioned over the wheel holding mechanism 58 of the parking bay. After parking the car, the car driver can collect his parking token from the token wending machine 155 provided at the entry point 15. A microchip provided inside the token enables to store the details of the car and parking time, so that the same information can be retrieved at the time of collecting his car, and to identify the car and money required to deposit for the car parking. A PIR sensor in the entry point is provided to identify the presence of a person, thereby enables to makes sure, no person in the parking bay before closes the shutter of parking bay.

The central car handling unit 12 aligns the collection-delivery rack 21 with parking bay as illustrated in FIG. 5. Now referring to FIG. 6, the electrical motor 63 attached to up-down platform 22 activates the rope & pulley mechanism 66 to push the moving frame 51 of collection-delivery rack 21 to engage with slot 57 in parking bay at entry point 15. Now referring to FIG. 9, an electrical motor [with fitted brake] 61 rotates the threaded rod 54 of jackey means 55, thereby enabling to expand the jackey means 55 and to push out the wheel arresting mechanism 53 to move [not shown] under the wheel of parked car 13. The set of movable triangular block 64 slides together on moving frame 51 against fixed block 65 of holding frame 52 to lift the holding frame 52 with wheel arresting mechanism 53 wherein the sliding movement is achieved with the help of threaded rod 101 and electrical motor with fitted brake 62 as shown in FIG. 10 and FIG. 11. Thereafter, the car 13 is released from floor of parking bay and arrested on the wheel arresting mechanism 53 of collection-delivery rack 21. The electrical motor 63 attached to the up-down platform 22 activates rope & pulley mechanism 66 and the whole collection-delivery rack 21 returns to the up-down platform 22.

Now referring to FIG. 18, the micro controller unit 150*a* decides proper position of storage/vacant slot with help of plurality of optical/laser sensors 152 provided at various position of car parking building 11. Based on the identified storage/vacant slot, the micro controller unit 150*a* controls the central handling unit 12 through the electrical motors [with fitted brakes] 143 on gliding platform 23 for horizontal alignment and through the electrical motors [with fitted brakes] 121 on up-down platform 22 for vertical alignment with respect to the identified position of storage/vacant slot. Accordingly, the car 13 placed on the collection-delivery rack 21 moves simultaneously in horizontal and vertical direction to reach to the identified storage/vacant slot, thereby enabling to reach to the identified storage/vacant slot in a shortest distance and in shortest time.

After the collection-delivery rack 21 perfectly aligns with vacant slot 14, the electrical motor 63 attached to up-down platform 22 activates rope & pulley mechanism 66 and pushes moving frame 51 towards the vacant parking slot 14. The set of movable triangular block 64 slides to separate each other on moving frame 51 against fixed block 65 of holding frame 52 with the help of threaded rod 54 and electrical motor [with fitted brake] 61, thereby enabling to move down holding frame 52 with wheel arresting mechanism 53, and the position of holding frame 52 moves from up to down, ie., as illustrated from FIG. 11 to FIG. 10. Now referring to FIG. 9, the electrical motor [with fitted brake] 61 rotates the threaded rod 54 of jackey mechanism 55, which enables to contract and pull the wheel arresting mechanism 53 to release the wheel of parked car on the wheel holding mechanism 58. Now the car is released to the floor of parking bay 71. The electrical motor 63 attached to up-down platform 22 with rope & pulley mechanism 66 pulls back the moving frame 51 of collection-delivery rack 21 to the up-down platform 22.

When the driver deposit the token in the token machine at exit point and pays the money, the micro controller identifies the car and do the above procedure in reverse sequence to deliver the specific car to delivery bay 71 at exit point 15. The gate of the exit point 15 gets open when the central handling unit 12 finishes the process and driver can collect the car 13.

As illustrated in FIG. 2, the entire three collection-delivery rack 21 can process collection or delivery of car independent to each other when they are aligned to parking/vacant/delivery slots.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

I claim:

1. An automatic multiprocessing car storing and retrieving system for multilevel car park comprising an integrated central car handling unit and a microcontroller unit, wherein said integrated central car handling unit comprising:

a plurality of collection-delivery racks to carry a plurality of cars;

at least one up-down platform to move the car vertically; and at least two gliding platforms to move the car horizontally;

wherein the up-down platform and gliding platform moves simultaneously thereby allowing the car to move simultaneously in horizontal and vertical directions;

wherein each collection-delivery rack comprises a moving frame, a holding frame and a plurality of wheel arresting mechanisms; a threaded rod; two movable triangular blocks, a fixed block, at least two jackey means, one electrical motor with fitted brake for rotating said threaded rod; and one reversible electrical motor with fitted brake for moving said two movable triangular block in both directions;

wherein the collection and delivery rack along with the microcontroller unit allows the car to transfer from the up-down platform to a parking bay without removing and lifting the car from the collection-delivery rack.

2. The automatic multiprocessing car storing and storing system of claim 1, wherein said collection-delivery rack is configured to attach to said up-down platform, wherein top and bottom ends of said up-down platform are configured to attach to said gliding platforms.

3. The automatic multiprocessing car storing and retrieving system of claim 1, wherein said up-down platform comprises of a holding platform; four guiding pillars; and a set of four sleeves.

4. The automatic multiprocessing car storing and retrieving system of claim 3, wherein said holding platform is configured to attach to four sleeves, wherein said sleeves are configured to slide on said guiding pillars.

5. The automatic multiprocessing car storing and retrieving system of claim 3, wherein said up-down platform further comprises of two reversible electric motors and a rope & pulley mechanism, wherein said reversible electrical motors are configured to attach to said rope & pulley mechanism and to engage said rope & pulley mechanism to move said collection-delivery rack laterally.

6. The automatic multiprocessing car storing and retrieving system of claim 5, wherein said up-down platform further comprises of a rack & pinion mechanism and a reversible electrical motor with fitted brakes, wherein said electrical motor is configured to attach to said rack & pinion mechanism and to engage said rack & pinion mechanism to move said up-down platform vertically.

7. The automatic multiprocessing car storing and retrieving system of claim 1, wherein said gliding platform comprises of a metal block; plurality of pulleys; a set of four guiding rails; and a reversible electrical motor with fitted brakes; wherein said reversible electrical motor is configured to engage said pulleys to move said gliding platforms horizontally.

8. The automatic multiprocessing car storing and storing system of claim 7, wherein said pulleys are configured to connect to both ends of said metal block and to slide on said set of four guiding rails.

9. The automatic multiprocessing car storing and retrieving system of claim 1, wherein said moving frame slides on sliding slots provided at a vertical frame of the up-down platform and the parking bay.

10. The automatic multiprocessing car storing and retrieving system of claim 1, wherein said threaded rod is configured to expand or contract said jackey means to move the wheel arresting mechanism outward or inward.

11. The automatic multiprocessing car storing and retrieving system of claim 1, wherein said two movable triangular block slides against a fixed block to lift or lower said holding frame and to lift or the car at the parking bay.

12. The automatic multiprocessing car storing and retrieving system of claim 1, wherein said microcontroller unit comprises a microcontroller, plurality of relay circuits, and a means for obtaining input from a plurality of optical or laser sensors provided at multilevel car parking system and pay booth.

13. The automatic multiprocessing car storing and retrieving system of claim 12, wherein said microcontroller controls all movements of said central car handling unit through the electrical motors based on the inputs from said plurality of optical/or laser sensors to identity a vacant slot, wherein said collection-delivery rack along with marked car moves to said vacant slot and vice versa.

* * * * *